US012604949B2

(12) United States Patent
Cheng

(10) Patent No.: US 12,604,949 B2
(45) Date of Patent: Apr. 21, 2026

(54) MANUAL EAR PIERCING GUN

(71) Applicant: Bo Cheng, Nanchang (CN)

(72) Inventor: Bo Cheng, Nanchang (CN)

(73) Assignee: Bo Cheng, Nanchang (CN)

( * ) Notice: Subject to any disclaimer, the term of this patent is extended or adjusted under 35 U.S.C. 154(b) by 39 days.

(21) Appl. No.: 18/557,016

(22) PCT Filed: Feb. 16, 2022

(86) PCT No.: PCT/CN2022/076514
§ 371 (c)(1),
(2) Date: Oct. 24, 2023

(87) PCT Pub. No.: WO2023/130531
PCT Pub. Date: Jul. 13, 2023

(65) Prior Publication Data

US 2024/0215691 A1 Jul. 4, 2024

(30) Foreign Application Priority Data

Jan. 4, 2022 (CN) ..... 202210004299.2

(51) Int. Cl.
*A44C 7/00* (2006.01)

(52) U.S. Cl.
CPC ..... *A44C 7/001* (2013.01)

(58) Field of Classification Search
CPC ..... A44C 7/001
See application file for complete search history.

(56) References Cited

U.S. PATENT DOCUMENTS

| | | | | |
|---|---|---|---|---|
| 4,931,060 A | 6/1990 | Aue | | |
| 5,263,960 A | 11/1993 | Mann | | |
| 5,360,434 A * | 11/1994 | Mann | A44C 7/001 | 606/188 |
| 2008/0208237 A1* | 8/2008 | Lei | A44C 7/001 | 606/188 |

FOREIGN PATENT DOCUMENTS

| | | | |
|---|---|---|---|
| CN | 200994481 | Y | 12/2007 |
| CN | 111358125 | A | 7/2020 |
| JP | 04263803 | A | 9/1992 |
| JP | 1023909 | A | 1/1998 |
| JP | 2000308504 | A | 11/2000 |

OTHER PUBLICATIONS

International Search Report of PCT/CN2022/076514.
Written Opinion of PCT/CN2022/076514.

* cited by examiner

*Primary Examiner* — Todd J Scherbel

(57) ABSTRACT

A manual ear-piercing gun, comprising a front gun part (1) and a rear gun part (2). The front gun part (1) and the rear gun part (2) are nested and can move linearly relative to each other. The front gun part (1) is constructed to have a mounting groove, and a sliding rail member (6) is provided in the mounting groove. A mounting slot (9*b*) for an earring backing mounting part (9) is formed between a side groove wall of the mounting groove and the end of the sliding rail member (6) away from the rear gun part (2). A sliding seat (5) for mounting an earring stud mounting part (10) is slidably connected to the sliding rail member (6), and the sliding seat (5) can move along with the relative linear motion of the front gun part (1) and the rear gun part (2).

9 Claims, 7 Drawing Sheets

MANUAL EAR PIERCING GUN

CROSS-REFERENCE TO RELATED APPLICATIONS

This Application is a national stage application of PCT/CN2022/076514. The present application claims priorities from PCT Application No. PCT/CN2022/076514, filed Feb. 16, 2022, and from Chinese Patent Application 202210004299.2 filed to the SIPO on Jan. 4, 2022, and entitled "MANUAL EAR PIERCING GUN", the disclosure of which are hereby incorporated by reference in its entirety.

TECHNICAL FIELD

The present disclosure belongs to the technical field of auxiliary mounting devices for accessories, and particularly relates to a manual ear piercing gun.

BACKGROUND ART

Ear piercing guns have emerged for a long time. Some piercing guns generally include a gun body, an earring stud mounting part and an earring back mounting part. During ear piercing, the earring stud mounting part and the earring backing mounting part approach each other, so that the both are closer to the earlobe. The earring stud mounting part continuously moves forward, and the tip of the earring stud pierces into the earring back through the earlobe. Then, the earring stud mounting part and the earring backing mounting part move away from each other and are separated from the gun body of the ear piercing gun, and the earring stud and the earring backing are left on the earlobe. Thus, the ear piercing process is completed. Depending upon different forces for driving the earring stud, these ear piercing guns are generally classified into automatic ear piercing guns and manual piercing guns. The automatic ear piercing guns will take a short time for piercing and complete piercing instantly with less pain and are easy for operators to use. Disadvantageously, the earring stud may cause impact damage to a thicker earlobe particularly due to inertia when the earring stud fast moves through the earlobe under the action of a spring.

SUMMARY

Therefore, the present disclosure provides a manual ear piercing gun, which can overcome the defect that an earring stud trigger spring of an automatic ear piercing gun in the prior art may cause impact damage to a user's earlobe due to inertia when the earring stud trigger spring triggers an earring stud to perform piercing.

To solve the above problem, the present disclosure provides a manual ear piercing gun, including a front gun part and a rear gun part, wherein the front gun part and the rear gun part are nested and can move linearly relative to each other; a mounting groove is formed in the front gun part, and a sliding rail member is provided in the mounting groove; a mounting slot for an earring backing mounting part is formed between the end of the sliding rail member away from the rear gun part and a side groove wall of the mounting groove; a sliding seat for mounting an earring stud mounting part is slidably connected to the sliding rail member; the sliding seat can move along with the relative linear movement of the front gun part and the rear gun part; a push rod is connected in the rear gun part; the positions of the push rod and the rear gun part are relatively fixed, and the push rod and the rear gun part can push an earring stud in the earring stud mounting part to move towards the earring backing mounting part during the linear movement of the rear gun part towards the front gun part.

In some implementations, the sliding rail member has two sliding rail arms extending towards one side of the rear gun part; a U-shaped opening structure is formed between the two sliding rail arms; the sliding seat is arranged in the U-shaped opening structure, and the sliding seat has an upper seat body in a region above the sliding rail arms and a lower seat body in a region below the sliding rail arms; and/or, the earring stud mounting part is pluggably connected in an assembly space of the sliding seat.

In some implementations, the other groove wall of the mounting groove is composed of a middle sidewall; the end of the sliding rail member close to the one sidewall of the mounting groove is fixedly connected to the front gun part; and, the free ends of the two sliding rail arms are inserted into a groove below the middle sidewall.

In some implementations, a bump is provided on the bottom side of the middle sidewall, and the bottom surface of the bump is resisted against the top surfaces of the free ends of the sliding rail arms.

In some implementations, the set mounting positions of the earring backing mounting part and the earring stud mounting part are packed in a blister box, and the blister box is removed after the earring backing mounting part is mounted in the mounting slot and the earring stud mounting part is mounted on the sliding seat.

In some implementations, the blister box has an outer flange, the middle sidewall has a horizontal wall extending towards one side of the sliding seat, and the extension length of the horizontal wall is not less than the width of the outer flange.

In some implementations, the manual ear piercing gun further includes a telescopic rod, one end of which is connected to the sliding seat while the other end of which is resisted against the wall of an inner cavity of the rear gun part through a telescopic rod spring.

In some implementations, a baffle, which is arranged adjacent to the telescopic rod and used for limiting the extension length of the telescopic rod, is provided in the inner cavity of the rear gun part.

In some implementations, the front gun part has a positioning pin, the rear gun part has a positioning groove, and the positioning pin is inserted into the positioning groove to limit the stroke of the relative linear movement between the front gun part and the rear gun part.

In some implementations, a reset spring is sandwiched between the front gun part and the rear gun part, so that the front gun part and the rear gun part can move away from each other after a user releases the force applied for the movement of the front gun part and the rear gun part towards each other.

In the manual ear piercing gun provided by the present disclosure, when a user applies a force to the front gun part and the rear gun part so that the both moves linearly towards each other, the sliding seat moves close to one side of the earring backing under the guidance of the guiding rail member, and the push rod moves with the rear gun part close to the earring stud and pushes the earring stud to pass through the earlobe and then insert into the earlobe to complete the ear piercing process. Since the positions of the push rod and the rear gun part are relatively fixed, the occurrence of impact damage caused by inertia when the push rod in the automatic ear piercing gun is triggered by the trigger spring is avoided.

Figure 1:
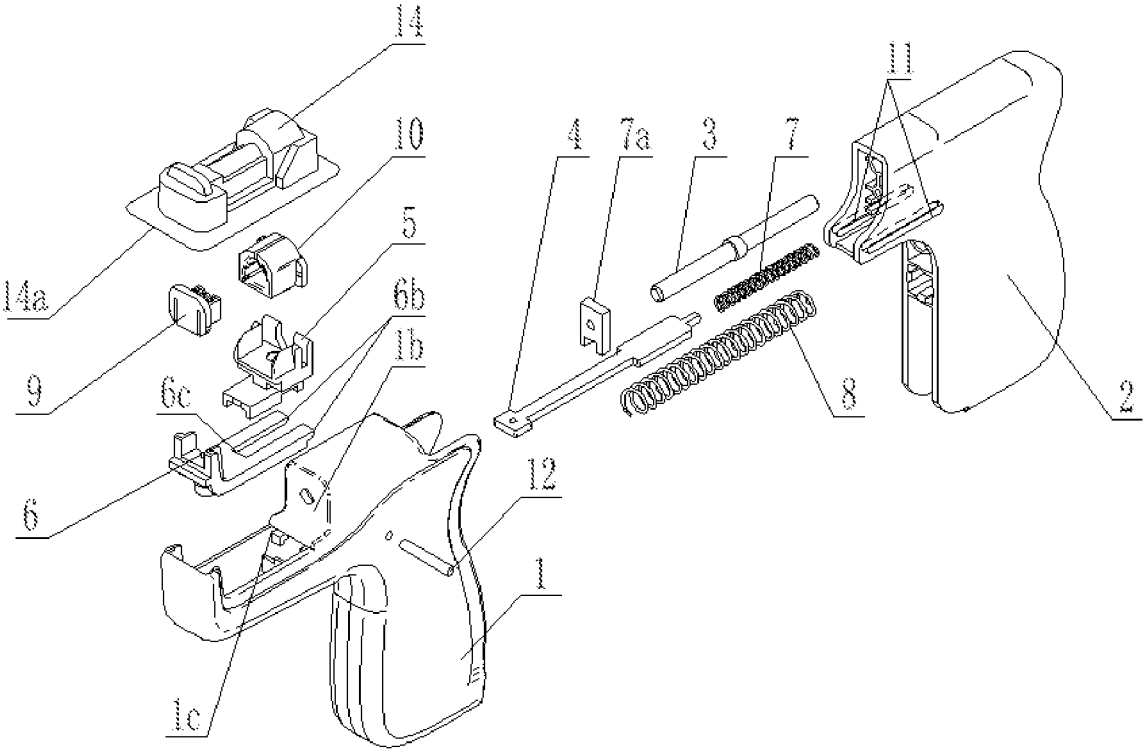
FIG. 1 is a schematic exploded view of a manual ear piercing gun according to an embodiment of the present disclosure.
Figure 2:
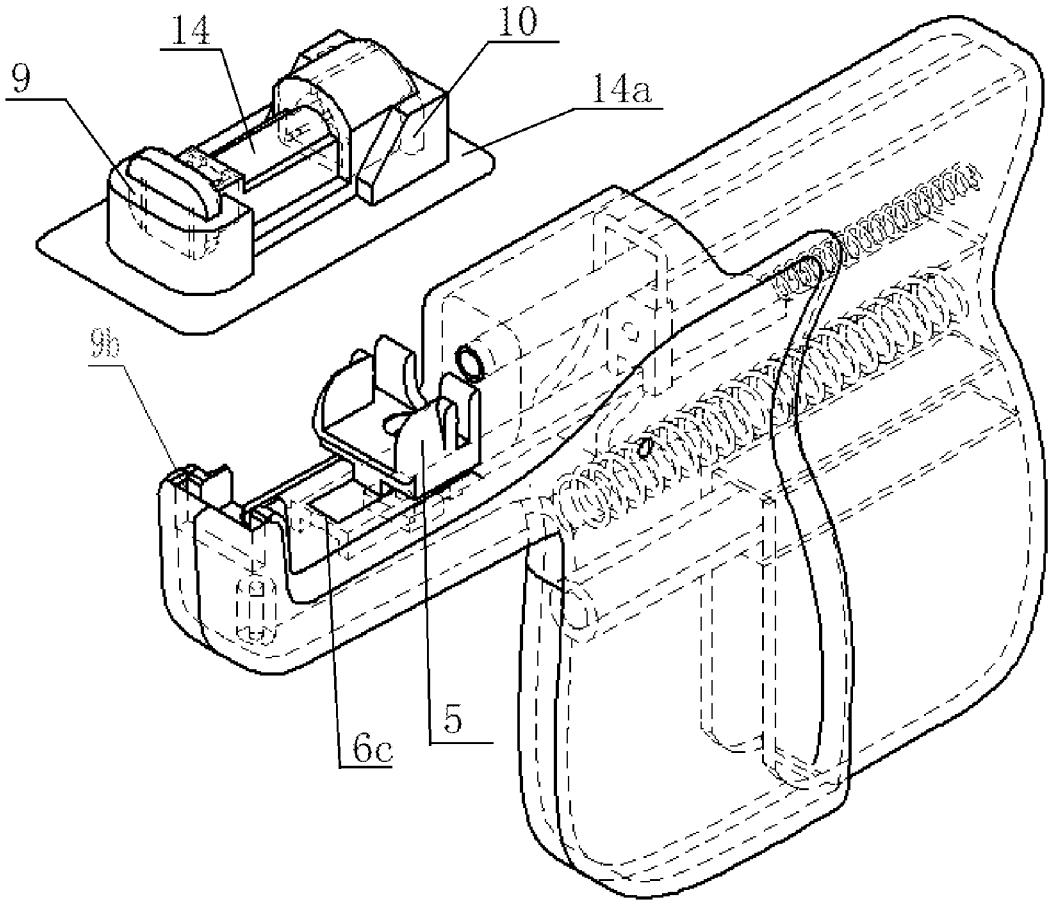
FIG. 2 is an assembly diagram of the manual ear piercing gun of FIG. 1.

in which:

1: front gun part; 1*a*: groove; 1*b*: middle sidewall; 1*c*: bump; 2: rear gun part; 3: push rod; 4: telescopic rod; 5: sliding seat; 6: sliding rail member; 6*a*: screw hole; 6*b*; sliding rail arm; 6*c*: U-shaped structure recess; 7: telescopic rod spring; 7*a*: baffle; 8: reset spring; 9: earring backing mounting part; 9*a*: earring backing; 9*b*: mounting slot; 10: earring stud mounting part; 10*a*: earring stud; 10*b*: earring stud holding member 1; 10*c*: earring stud holding member 2; 11: positioning groove; 12: positioning pin; 13: gap; 14: blister box; and, 14*a*: flange.

DETAILED DESCRIPTION

With reference to FIGS. 1 to 7, in accordance with an embodiment of the present disclosure, a manual ear piercing gun is provided, including a front gun part 1 and a rear gun part 2. The front gun part 1 and the rear gun part 2 are nested and can move linearly relative to each other. A mounting groove is formed in the front gun part 1, and a sliding rail member 6 is provided in the mounting groove. A mounting slot 9*b* for an earring backing mounting part 9 is formed between the end of the sliding rail member 6 away from the rear gun part 2 and one side groove wall of the mounting groove. A sliding seat 5 for mounting an earring stud mounting part 10 is slidably connected to the sliding rail member 6. The sliding seat 5 can move along with the relative linear movement of the front gun part 1 and the rear gun part 2. A push rod 3 is connected in the rear gun part 2. The positions of the push rod 3 and the rear gun part 2 are relatively fixed, and the push rod 3 and the rear gun part 2 can push an earring stud 10*a* in the earring stud mounting part 10 to move towards the earring backing mounting part 9 during the linear movement of the rear gun part 2 towards the front gun part 1. In this technical solution, when the user applies a force to the front gun part 1 and the rear gun part 2 so that the both moves linearly towards each other (that is, the both are folded), the sliding seat 5 moves close to one side of the earring backing 9*a* under the guidance of the sliding rail member 6, and the push rod 3 moves with the rear gun part 2 close to the earring stud 10*a* and pushes the earring stud 10*a* to pass through the earlobe and then insert into the earlobe to complete the ear piercing process. Since the positions of the push rod 3 and the rear gun part 2 are relatively fixed, the occurrence of impact damage caused by inertia when the push rod in the automatic ear piercing gun is triggered by the trigger spring is avoided.

The sliding rail member 6 has two sliding rail arms 6*b* extending towards one side of the rear gun part 2, and a U-shaped opening structure is formed between the two sliding rail arms 6*b*. The sliding seat 5 is arranged in the U-shaped opening structure, and the sliding seat 5 has an upper seat body in a region above the sliding rail arms 6*b* and a lower seat body in a region below the sliding rail arms 6*b*. Thus, the closed position (i.e., the U-shaped structure recess 6*c*) of the U-shaped opening structure can limit the movement position of the sliding seat 5 towards one side of the earring backing 9*a*, thereby ensuring the consistency of the gap between the earring stud 10*a* and the earring backing 9*a*.

The earring stud mounting part 10 is pluggably connected in an assembly space of the sliding seat 5, thereby ensuring the universality and reusability of the manual ear piercing gun.

The other groove wall of the mounting groove is composed of a middle sidewall 1*b*, and the end of the sliding rail member 6 close to the one sidewall of the mounting groove is fixedly connected to the front gun part 1. Specifically, a screw hole 6*a* that can be fixedly connected to the front gun part 1 through a corresponding screw is formed at the end of the mounting groove. The free ends of the two sliding rail arms 6*b* are inserted into a groove 1*a* below the middle sidewall 1*b*. The free ends of the sliding rail arms 6*b* can be limited to a certain extent by the groove 1*a*, so that the position reliability of the sliding rail member 6 is ensured.

Since the earring stud mounting part 10 is pluggably connected in the sliding seat 5, the earring stud mounting part 10 will drive the sliding seat 5 to have an upward force when it is pulled out from the sliding seat 5, and the lower seat body of the sliding seat 5 will drive the free ends of the two sliding rail arms 6*b*, so that the sliding arm arms 6*b* form an upward bending moment, it is disadvantageous for the sliding of the sliding seat 5 slidably connected on the sliding rail arms 6*b*, and the damage to the sliding rail member 6 will reduce the service life of the manual ear piercing gun. Based on this hidden trouble, a corresponding bump 1*c* is provided on the bottom side of the middle sidewall 1*b*, and the bottom surface of the bump 1*c* is resisted against the top surfaces of the free ends of the sliding rail arms 6*b*, so that the position stability of the sliding rail arms 6*b* can be effectively ensured, and the upward deformation of the free ends can be effectively avoided.

The set mounting positions of the earring backing mounting part 9 and the earring stud mounting part 10 are packed in a blister box 14, and the blister box 14 is removed after the earring backing mounting part 9 is mounted in the mounting slot 9*b* and the earring stud mounting part 10 is mounted on the sliding seat 5, thereby avoiding hand to contact and pollute the sterilized ear stud and improving safety. The blister box 14 has an outer flange 14*a* (which is about 5 mm in a specific embodiment), the middle sidewall 1*b* has a horizontal wall extending towards one side of the sliding seat 5, and the extension length of the horizontal wall is not less than the width of the outer flange 14*a* (specifically referring to the gap 13 in FIG. 4). Thus, the horizontal wall limits the position of one side of the sliding seat 5, and the successful alignment of the blister box 14 can be ensured after the resetting of the front gun part 1 and the rear gun part 2 is ensured.

Figure 3:
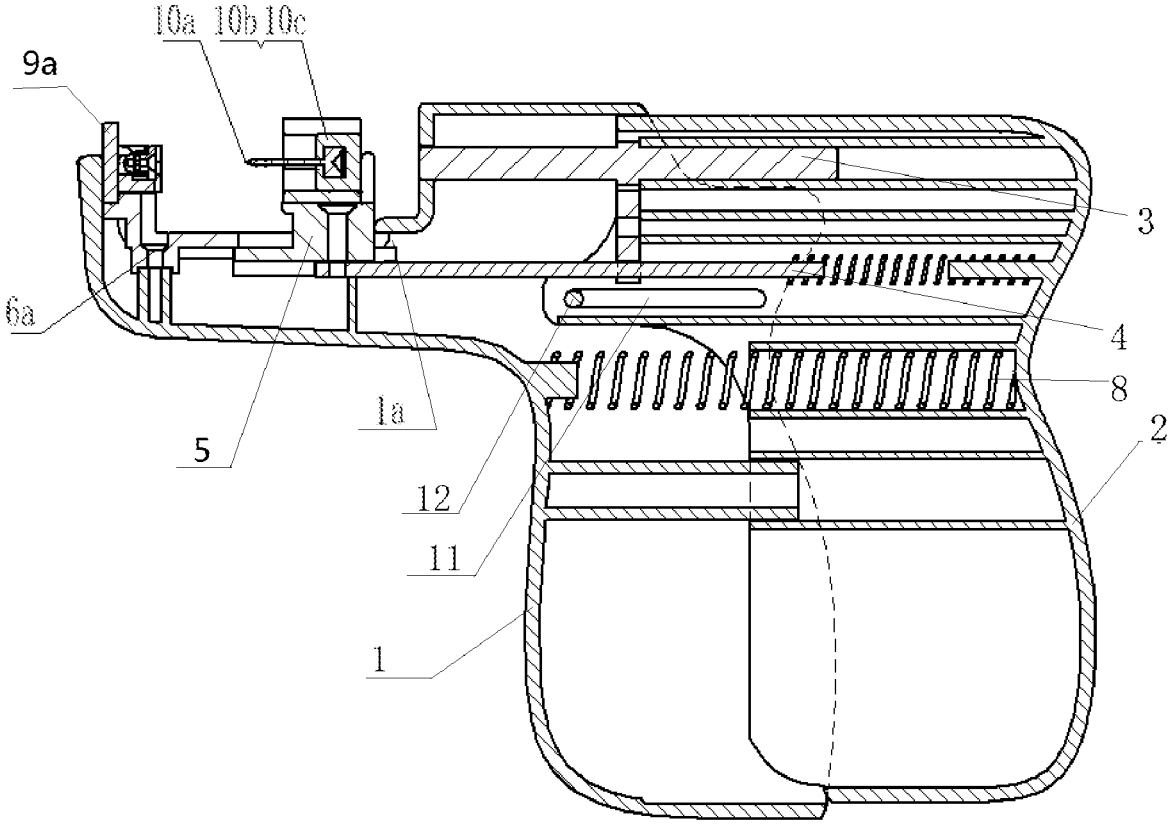
FIG. 3 is a schematic sectional view of the manual ear piercing gun of FIG. 2.
Figure 4:
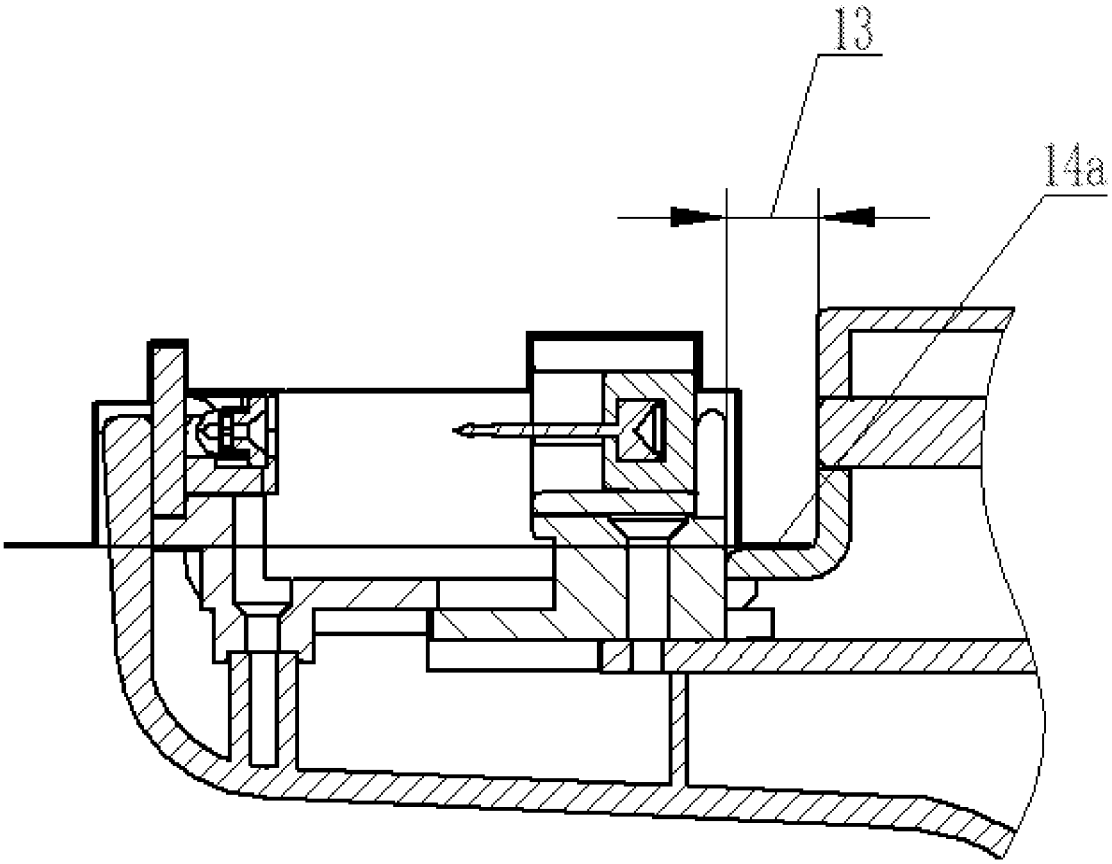
FIG. 4 is an assembly diagram of the manual ear piercing gun and the earring backing and earring stud component packed by a blister box according to an embodiment of the present disclosure.
Figure 5:
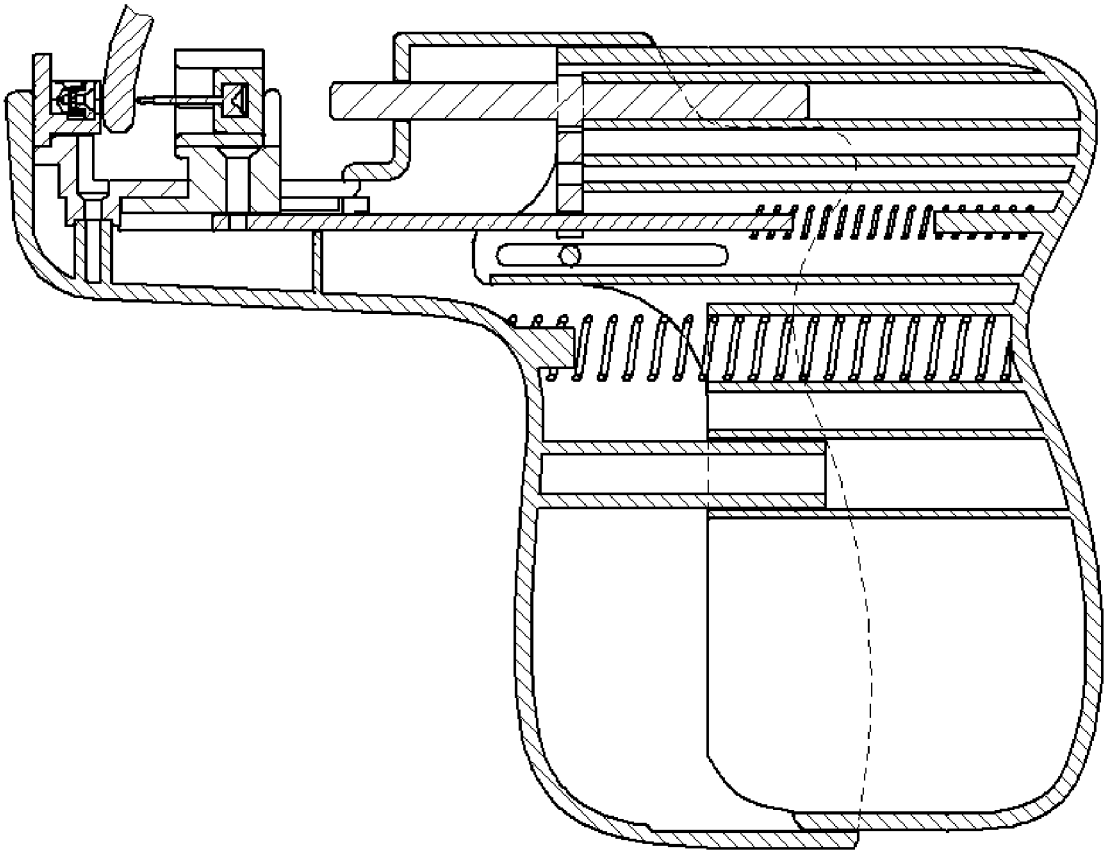
FIG. 5 is a state diagram of a process of aligning the earring stud in the manual ear piercing gun according to an embodiment of the present disclosure.
Figure 6:
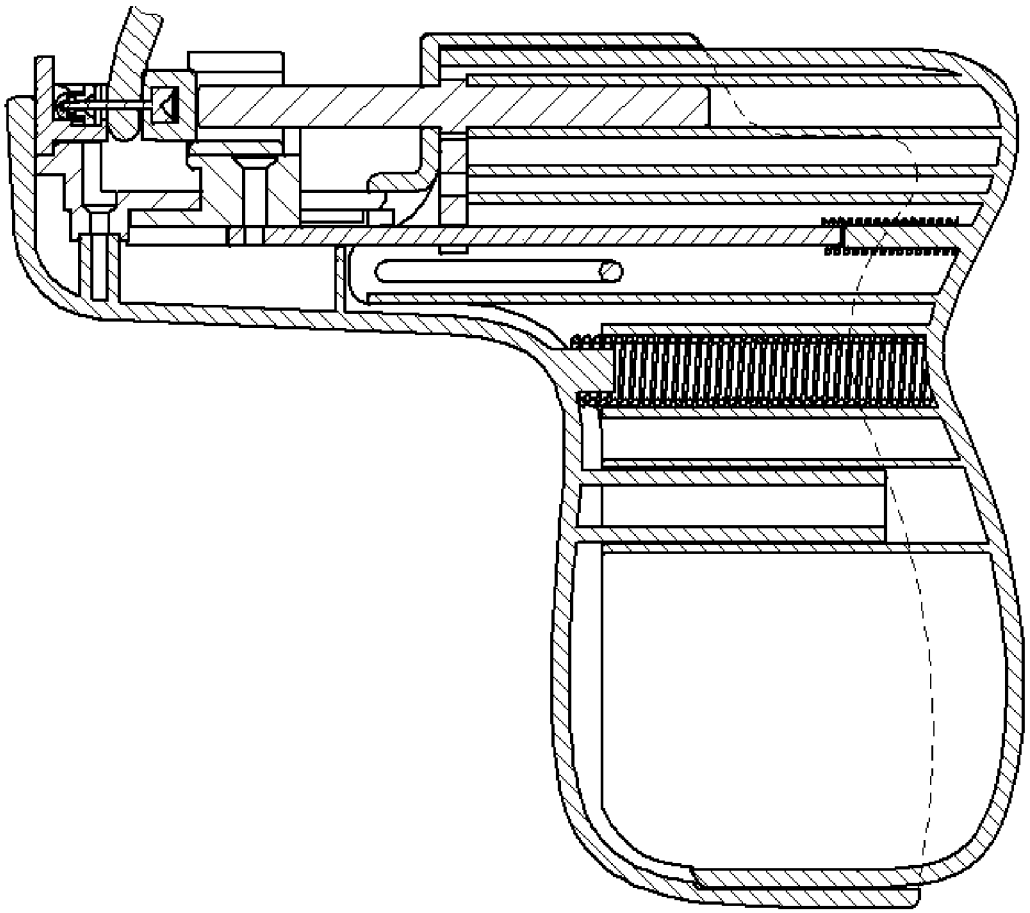
FIG. 6 is a state diagram of the push rod in the manual ear piercing gun pushing the earring stud to pierce through the user's earlobe according to an embodiment of the present disclosure.
Figure 7:
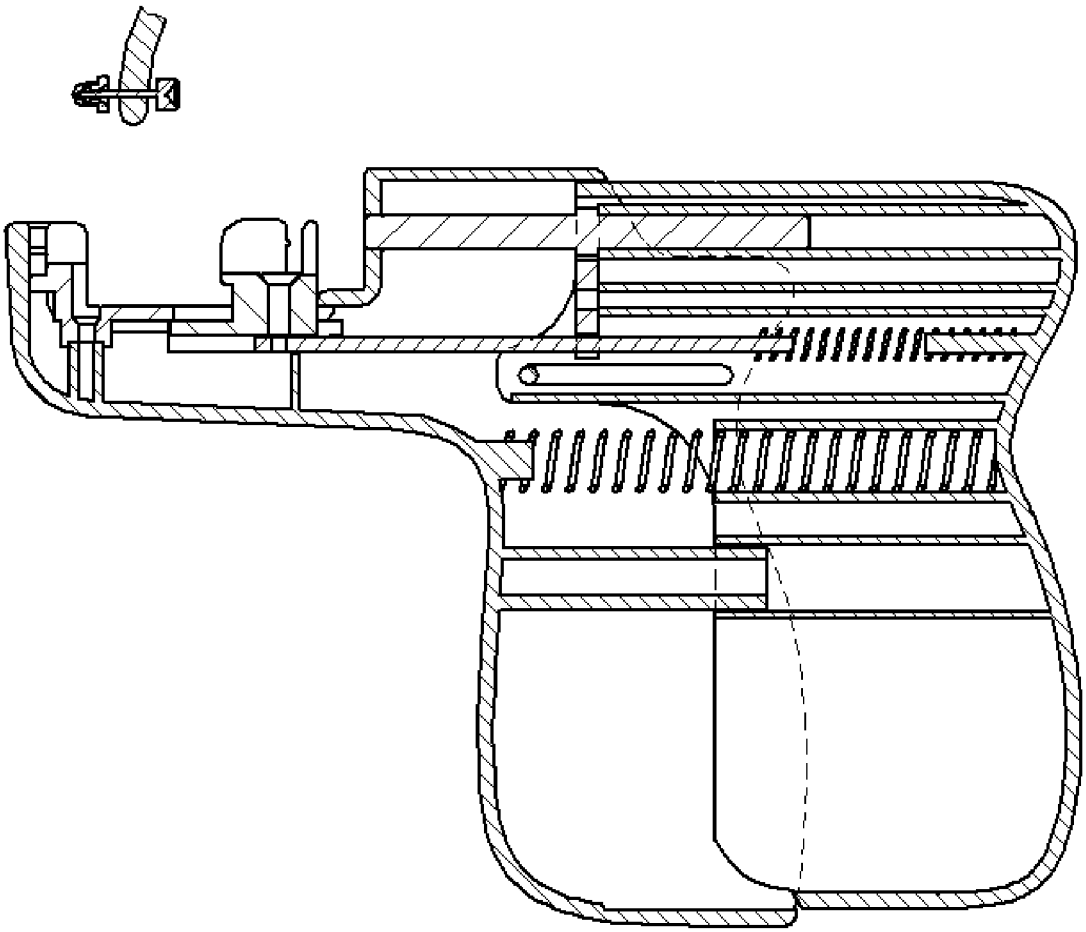
FIG. 7 is a state diagram of restoring the original state after the manual ear piercing gun completes ear piercing according to an embodiment of the present disclosure.

In some implementations, the manual ear piercing gun further includes a telescopic rod 4, one end of which is connected to the sliding seat 5 while the other end of which is resisted against the wall of an inner cavity of the rear gun part 2 through a telescopic rod spring 7, specifically referring to FIG. 3. The telescopic rod 4 and the telescopic rod spring 7 are arranged in the corresponding transverse grooves, so that the stability and reliability during the telescopic process can be ensured. A baffle 7*a*, which is arranged adjacent to the telescopic rod 4 and used for limiting the extension length of the telescopic rod 4, is provided in the inner cavity of the rear gun part 2. It should be understood that the extension strength of the telescopic rod 4 should be based on the distance as a target distance between the sliding seat 5 connected to one end and the earring backing 9*a*, and this target distance can be determined according to the thickness of the earlobe.

The front gun part 1 has a positioning pin 12, the rear gun part 2 has a positioning groove 11, and the positioning pin 12 is inserted into the positioning groove 11 to limit the stroke of the relative linear movement between the front gun part 1 and the rear gun part 2. The length of the positioning groove 11 determines the maximum closing stroke of the front gun part 1 and the rear gun part 2, i.e., the maximum stroke that the push rod 3 can push the earring stud 10*a*.

A reset spring 8 is sandwiched between the front gun part 1 and the rear gun part 2, so that the front gun part 1 and the rear gun part 2 can move away from each other after the user releases the force applied to the movement of the front gun part 1 and the rear gun part 2 towards each other, thereby restoring the initial state of the manual ear piercing gun.

The service process of the manual ear piercing gun of the present disclosure will be further described below.

When it is necessary to perform ear piercing, a palm holds the lower part of the gun-shaped structure, and the palm contracts to compress the reset spring 8, so that the rear gun part 2 moves to the front gun part 1 (closing process). Since the telescopic rod spring 7 is also compressed, the sliding seat 5 and the earring stud mounting part 9 on the sliding seat 5 moves close to the earring backing mounting part 10. At this time, it is equivalent that the earring stud 10*a* moves close to the earlobe to be pierced. Aiming at the position to be pierced, the reset spring 8 is continuously compressed. When the slider moves the U-shaped structure recess 6*c* and cannot move forward, the earring stud 10 reaches the position to be pierced, and the reset spring 8 is continuously compressed, and the push rod 3 pushes the earring stud 10*a* on the earring stud mounting part 10 to continuously move forward and enter the earring backing 9*a* through the earlobe.

Since the earring backing mounting part 9 is designed with a mechanism that the earring backing 9*a* will be separated from the earring backing mounting part 9 when the earring stub 9 is inserted into the earring backing 9*a* and the earring stud mounting part 10 is also designed with a mechanism that the earring stud 10*a* or its gripping members 10*b* and 10*c* will be separated from the earring stud mounting part 10 when the earring stud 10 is inserted into the earring backing, so when the reset spring 8 is release, the front gun part 1, the rear gun part 2 and the telescopic rod 4 will be reset automatically, and the earring stud 10*a* and the earring backing 9*a* will be separated from the earring stud mounting part 10 and the earring backing mounting part 9 and then left on the earlobe. Thus, the whole ear piercing process is completed.

It should be readily understood by those skilled in the art that the above advantages can be freely combined and superimposed if not conflicted.

The above description merely shows the preferred embodiments of the present disclosure and is not intended to limit the present disclosure. Any modification, equivalent replacement or improvement made without departing from the spirit and principle of the present disclosure shall fall into the protection scope of the present disclosure. The above description merely shows the preferred implementations of the present disclosure, and it should be pointed out that, to a person of ordinary skill in the art, various improvements and modifications can be made without departing from the technical principle of the present disclosure and these improvements and modifications shall be regarded as falling into the protection scope of the present disclosure.

The invention claimed is:

1. A manual ear piercing gun, comprising a front gun part (1) and a rear gun part (2), wherein the front gun part (1) and the rear gun part (2) are nested and can move linearly relative to each other; the front gun part (1) is formed with a mounting groove, and a sliding rail member (6) is provided in the mounting groove; a mounting slot (9b) for an earring backing mounting part (9) is formed between the end of the sliding rail member (6) away from the rear gun part (2) and one side groove wall of the mounting groove; a sliding seat (5) for mounting an earring stud mounting part (10) is slidably connected to the sliding rail member (6);

the sliding seat (5) can move along with the relative linear movement of the front gun part (1) and the rear gun part (2); a push rod (3) is connected in the rear gun part (2); the positions of the push rod (3) and the rear gun part (2) are relatively fixed, and the push rod (3) and the rear gun part (2) can push an earring stud (10*a*) in the earring stud mounting part (10) to move towards the earring backing mounting part (9) during the linear movement of the rear gun part (2) towards the front gun part (1).and the sliding rail member (6) has two sliding rail arms (6*b*) extending towards one side of the rear gun part (2); a U-shaped opening structure is formed between the two sliding rail arms (6*b*), the sliding seat (5) is arranged in the U-shaped opening structure, and the sliding seat (5) has an upper seat body in a region above the sliding rail arms (6*b*) and a lower seat body in a region below the sliding rail arms (6*b*).

2. The manual ear piercing gun according to claim 1, wherein the other groove wall of the mounting groove is composed of a middle sidewall (1*b*); the end of the sliding rail member (6) close to the one sidewall of the mounting groove is fixedly connected to the front gun part (1); and, the free ends of the two sliding rail arms (6*b*) are inserted into a groove (1*a*) below the middle sidewall (1*b*).

3. The manual ear piercing gun according to claim 2, wherein a bump (1*c*) is provided on the bottom side of the middle sidewall (1*b*), and the bottom surface of the bump (1*c*) is resisted against the top surfaces of the free ends of the sliding rail arms (6*b*).

4. The manual ear piercing gun according to claim 2, wherein the set mounting positions of the earring backing mounting part (9) and the earring stud mounting part (10) are packed in a blister box (14), and the blister box (14) is removed after the earring backing mounting part (9) is mounted in the mounting slot (9*b*) and the earring stud mounting part (10) is mounted on the sliding seat (5).

5. The manual ear piercing gun according to claim 4, wherein the blister box (14) has an outer flange (14*a*), the middle sidewall (1*b*) has a horizontal wall extending towards one side of the sliding seat (5), and the extension length of the horizontal wall is not less than the width of the outer flange (14*a*).

6. The manual ear piercing gun according to claim 1, further comprising a telescopic rod (4), one end of which is connected to the sliding seat (5) while the other end of which is resisted against the wall of an inner cavity of the rear gun part (2) through a telescopic rod spring (7).

7. The manual ear piercing gun according to claim 6, wherein a baffle (7*a*), which is arranged adjacent to the telescopic rod (4) and used for limiting the extension length of the telescopic rod (4), is provided in the inner cavity of the rear gun part (2).

8. The manual ear piercing gun according to claim 1, wherein the front gun part (1) has a positioning pin (12), the rear gun part (2) has a positioning groove (11), and the positioning pin (12) is inserted into the positioning groove (11) to limit the stroke of the relative linear movement between the front gun part (1) and the rear gun part (2).

9. The manual ear piercing gun according to claim 1, wherein a reset spring (8) is sandwiched between the front gun part (1) and the rear gun part (2), so that the front gun part (1) and the rear gun part (2) can move away from each other after a user releases the force applied for the movement of the front gun part (1) and the rear gun part (2) towards each other.

* * * * *